US006010635A

United States Patent [19]

Goode, Jr. et al.

[11] Patent Number: 6,010,635

[45] Date of Patent: Jan. 4, 2000

[54] PLASMA DESCALING OF METALS

[75] Inventors: Herbert S. Goode, Jr.; Jean A. Nielsen, both of Kent; Larry E. Nitzsche, Bellevue, all of Wash.

[73] Assignee: The Boeing Company, Seattle, Wash.

[21] Appl. No.: 08/975,242

[22] Filed: Nov. 21, 1997

[51] Int. Cl.[7] ..... H05H 1/00

[52] U.S. Cl. ..... 216/67; 216/75; 216/76; 216/77; 148/421

[58] Field of Search ..... 216/67, 75, 76, 216/77; 148/421

[56] References Cited

U.S. PATENT DOCUMENTS 5,681,486 10/1997 Goode et al. ..... 216/67
5,843,289 1/1998 Lee et al. ..... 4/4

*Primary Examiner*—Kishor Mayekar

*Attorney, Agent, or Firm*—John C. Hammar

[57] ABSTRACT

The plasma descaling process of the present invention removes surface oxides selectively from structural metal surfaces, especially titanium and its alloys, and, with appropriate control of the reaction temperature, is self-limiting to avoid cracking problems otherwise associated with intergranular attack. In a preferred embodiment of the present invention, a fluoride plasma reacts with surface oxides on a titanium alloy to remove scale and alpha case in a temperature controlled chamber without attacking the underlying crystalline metal to cause intergranular attack. Properly controlled by regulating the chamber temperature, the plasma reaction terminates when the plasma has removed the surface oxides and encounters the underlying crystalline metal. The product is a metal surface free of scale and alpha case and free of intergranular attack. The plasma descaling process replaces conventional metal finishing processes, such as chemical milling or etching.

12 Claims, 1 Drawing Sheet

PLASMA DESCALING OF METALS

NOTICE OF GOVERNMENT RIGHTS

This invention was made with Government support under Contract F33615-93-C-4302 awarded by the Air Force. The Government has certain rights to this invention.

TECHNICAL FIELD

The present invention relates to plasma descaling of metals.

BACKGROUND OF THE INVENTION

Titanium alloys, aluminum alloys, and other metals commonly are used in aircraft skin and support structures because of their relatively light weight, high absolute strength, and high strength-to-weight ratio. To achieve desired physical properties, the alloys often are heat treated, which produces a dense, tightly adherent oxide in the form of scale or alpha case (or both) on outer surface. This oxide typically ranges in thickness from about 0.0001 to about 0.010 inches. It must be removed before subsequent machining, forming, or joining operations. Scale covered parts cannot be welded. Alpha case is difficult to machine and causes excessive tool wear or tool breakage. Also, alpha case can be a point source for cracking that may result in catastrophic failure.

Commonly today, the oxide is removed through chemical milling or etching of the metal in a series of chemical baths of highly toxic and corrosive concentrated alkaline and acid, including mixtures of nitric acid and hydrofluoric acid. Aerospace approved etching processes of this type are described in Boeing Process Specifications BAC 5753 "Cleaning, Descaling, and Surface Preparation of Titanium and Titanium Alloys" and BAC 5842 "Chemical Milling of Titanium." As a consequence, the baths and ancillary equipment that come into contact with these corrosive chemicals must be fabricated from expensive exotic materials that are resistant to attack.

To remove the surface oxide, then, the metal typically is immersed sequentially in acid baths for a period of time estimated to dissolve the scale without causing significant intergranular attack on the underlying titanium alloy substrate. Overimmersion results in undesirable intergranular attack. Underimmersion leaves scale or alpha case on the surface. On a single part, both underimmersion and overimmersion can occur at different locations on the surface. Either condition (i.e., intergranular attack or failure to remove surface oxides) can leave crack initiation sites (a "point source") for catastrophic failure of the part through cracking. Adjusting the chemical milling etch rate requires constant monitoring of the baths and frequent replenishment of the solution's constituents (i.e., the reagent's) of reagents. Orientation of the part in the bath effects the etch rate. Hydrogen generated during acid-etching may also migrate into the alloy structure causing "hydrogen-embrittlement"—a serious problem that reduces fatigue strength significantly. To avoid hydrogen embrittlement, treated parts usually are baked to remove the hydrogen.

Chemical milling generates a hazardous wastewater containing heavy metal ions that must be disposed of in an environmentally acceptable manner. Such disposal is becoming increasingly costly. The costs are detailed in U.S. patent application Ser. No. 08/522,644, filed Sep. 1, 1995 entitled "Removing Heavy Metals from Industrial Wastewater", now abandoned.

SUMMARY OF THE INVENTION

Plasma descaling of the present invention eliminates the immersion tanks and generates little, if any, hazardous waste. The preferred, temperature-controlled process removes the surface oxide without causing intergranular attack of the underlying metal. Therefore, the process of the present invention reduces environmental hazards associated with the chemical etching process while producing parts of higher quality and assurance with complete removal of the surfaces oxides without intergranular attack. The process is simpler to operate than the chemical etching because of the self-limiting oxide removal, which eliminates concerns of overimmersion.

The plasma descaling process of the present invention removes surface oxides on metals generally without producing toxic or hazardous wastes. The process removes alpha case, and leaves a clean metal surface necessary for assuring the integrity of aerospace structural assemblies. The process is particularly well suited for the removal of scale from titanium or titanium alloy substrates, although it is also suited for aluminum, aluminum alloys, INCONEL (i.e. nickel-iron-chrome alloys), other nickel alloys and other structural metals. The process typically removes the surface oxides at a rate of at least about 0.0001 in/hr, and preferably at least about 0.0005 to about 0.0020 in/hr. A plasma contacts the surface oxide and removes it Typically, the plasma contains fluoride ions from source gases such as $CF_4$, $SF_6$, and the like or mixtures of gases. Usually, the metal is heated in a plasma environment to about 100–600° C. at which temperature the plasma reacts with the surface oxides, both scale and alpha case. Removal of these surface oxides occurs without intergranular attack of the underlying metal, at least in the case of titanium and its alloys. The plasma reaction self-terminates at these preferred temperatures when the plasma has reacted with the surface oxides and the plasma encounters the underlying metallic substrate. Consequently, the plasma descaling process removes the surface oxides uniformly on all surfaces of the substrate.

The plasma descaling process of the present invention removes the surface oxides selectively and, with appropriate control of the reaction temperature, is self-limiting to avoid the problems associated with intergranular attack.

The process may be carried out in commercially available plasma generating chambers that are modified with heaters in accordance with the present invention. Preferably, but not necessarily, the plasma chamber is supplied with radiation, inductive, kinetic, or conductive heating means, or a combination thereof, so that a titanium or titanium alloy substrate placed within the chamber may be heated to within the desired temperature range. Thereafter, the heated component is subjected to the plasma to remove the surface oxides.

DETAILED DESCRIPTION OF THE INVENTION

Figure 1:
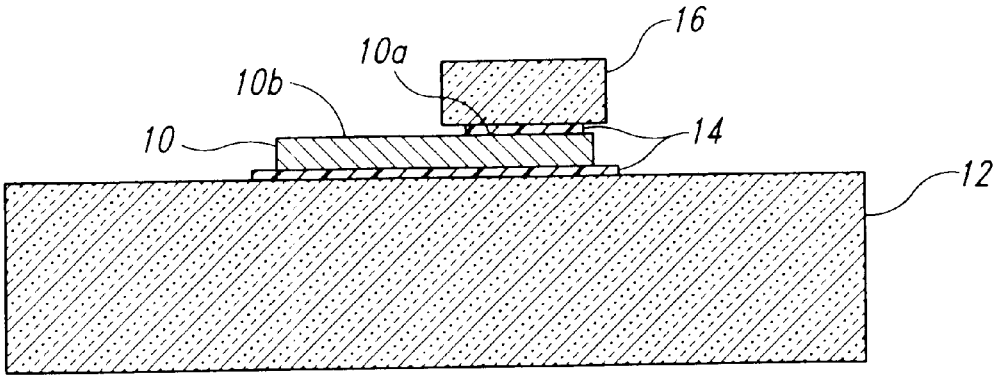
FIG. 1 is a cross-sectional view showing a titanium alloy substrate with one side of its upper surface exposed for etching, and the other side of the upper surface covered with an adhered silicon mask.

The present invention addresses a significant problem in the surface treatment of metals to remove surface oxides in the form of scale or alpha case without generating hazardous waste.

Alpha case is a thick, dense surface oxide that, for titanium, has a pyramidal crystalline structure. Scale is a thin amorphous oxide. The process of the present invention removes both to leave a clean metal surface. The plasma only attacks the surface oxides and does not remove the underlying oxide-free surface. Acid etching often involves intergranular attack of the underlining metal. With the process of the present invention, it is easier to design the part to the minimum dimensions and to produce such parts repeatedly to the design criteria because the plasma descaling is self-limiting.

While we use the term "plasma descaling," we generally mean the simultaneous removal of both scale and alpha case.

A "plasma" is more correctly identified as a particle plasma, being a neutral mixture of positively and negatively charged particles interacting with an electromagnetic field. The field dominates motion of the particles. HAWLEY'S CONDENSED CHEMICAL DICTIONARY, 11th Ed. (N. I. Sax, ed.), Von Nostrand Reinhold Co. NY (1987) p. 924. It is broadly defined as a state of matter in which a significant number of the atoms or molecules are electrically charged or ionized. The vast majority of matter in the universe exists in the plasma state, although artificially created plasmas are most commonly put to beneficial use. Gaseous plasmas sustained by electric fields at reduced pressure, either under direct or alternating current, are sometimes referred to as glow discharges. "Plasma" reflects the fact that glowing gas discharges, at least, mold to the shape of their container and to items being processed in the container. More general information about plasmas is provided in the ENCYCLOPEDIA OF CHEMICAL TECHNOLOGY, vol. 19, 4th Ed., John Wiley & Sons, NY (1996) pp. 226–258.

Plasma descaling can be conducted in any suitable chamber for generation of a suitable plasma from a source gas. The chamber may be modified, by installation of a supplemental heater to preheat the substrate prior to introducing the plasma. For titanium alloys, we typically preheat to about 100–600° C., preferably about 150–550° C., and, most preferably, to about 220–520° C. Of course, the substrate may be preheated in a separate oven and then transferred to the plasma chamber. The preheating improves the plasma descaling etch rate and makes the present process economically viable. We seek an etch rate of about 0.0001–0.0020 inches/hr, and, preferably, about 0.0005–0.0020 inches/hr. Temperatures to achieve this rate vary from metal to metal. Temperatures necessary for aluminum alloys typically are lower than those for titanium.

For titanium alloys, we prefer to use a fluoride plasma. For aluminum, the best plasma might be a chloride plasma or a mixed chloride/fluoride plasma. We produce the plasma from a suitable source gas or a mixture of gases, as is conventional. For titanium alloys we use $CF_4$, $SF_6$, $NF_3$ or a mixture of gases.

The surface to be descaled generally is cleaned using conventional techniques to remove surface grime and dirt. Cleaning methods are described in BAC 5753 to which we referred earlier. Heat-treated titanium or titanium alloy is crystalline and the surface oxides are tightly adhered to this underlying crystalline metal. Typically, scale ranges in thickness about 0.0001 to 0.010 inch. Alpha case typically has a thickness in the range from 0.001 to about 0.007 inches. To prepare the metallic part for subsequent machining, forming, or joining operations, the surface oxides must be removed.

The plasma chamber generally is evacuated to a high vacuum pressure of about 0.13–0.40 Pascal (0.1–0.3 milliTorr) and, preferably, less than 0.33 Pascal. Then, the source gas from which the plasma is formed is introduced into the chamber at a flow rate sufficient to produce a useful concentration of the plasma etching ions. For instance, for a 6.3 liter volume chamber, a flow rate from about 20–80 standard $cm^3$/min (sccm) of fluoride ion-producing gas, along with lesser amounts of water-free (dry) oxygen, argon, or both at the flow rate of from about 1–10 (sccm) is suitable. Preferably the flow is about 1–5 sccm. The source gas for titanium descaling may be selected from any of the gases that produce a fluoride ion when subjected to a radio frequency discharge. Thus, for example, the fluoride ion-producing gas is exemplified by fluorocarbons, sulfur fluorides, phosphorous fluorides, nitrogen fluoride, and the like. Preferably, the power concentration in the radio frequency discharge is at least about 1.0 watt per centimeter for $SF_6$, and at least about 0.5 watts per centimeter for $CF_4$.

Controlling the temperature of the substrate results in descaling without intergranular attack of the underlying crystalline metal. Optionally, the substrate temperature may be carefully raised after descaling to lightly etch the substrate surface. Generally, the plasma reaction self-terminates when the plasma has reacted with all the surface oxide. Since alpha case usually forms unevenly over the surface, the removal of the alpha case results in a surface that has a certain roughness by microelectronic standards but has an excellent surface finish by aerospace standards.

Importantly, aerospace titanium parts to be welded typically have a surface finish of $R_a$ ranging from about 30–60. This surface finish range is achieved using the plasma descale process of the invention alone, without further treatment. The prior art chemical tank immersion processes, described above, typically produced rougher surfaces having $R_a$'s in the range about 40–120, and generally required additional surface treatments.

The surface produced by the descaling process of the invention is suitable for dye penetrant inspection. Importantly, since the titanium substrate is not exposed to hydrogen during the process of the invention, the risk of hydrogen embrittlement does not arise. Moreover, the need for subsequent baking cycles to remove entrapped hydrogen is eliminated.

Figure 2:
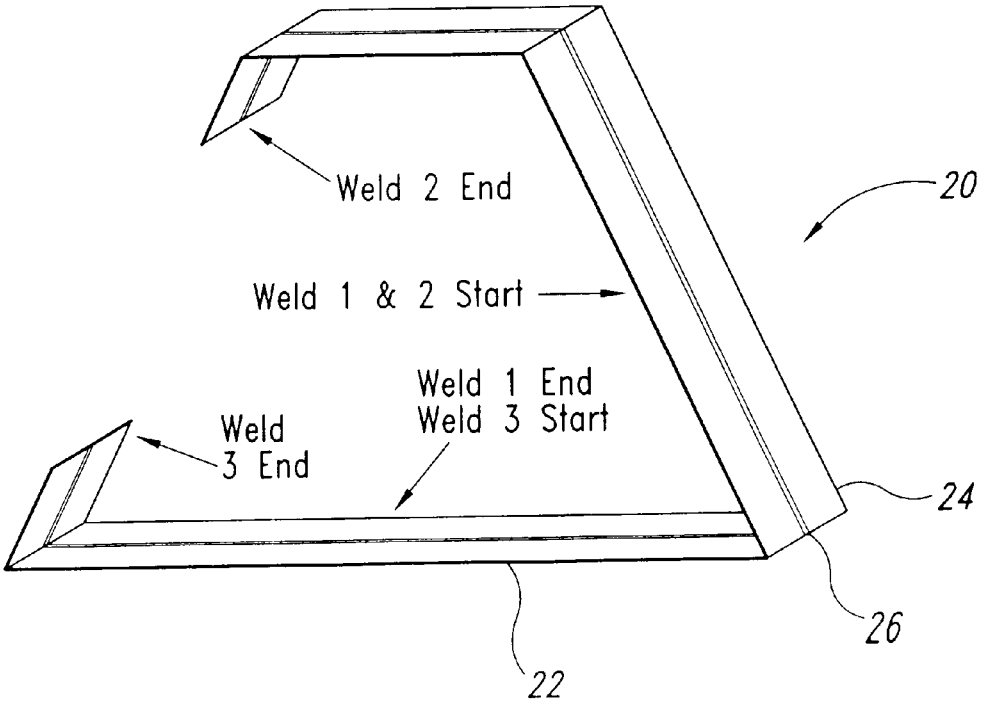
FIG. 2 is an isometric of a portion of a typical, welded aerospace structure (a forward boom) suitable for descaling in accordance with the present invention.

FIG. 2 shows a typical forward boom 20 for a fighter aircraft formed from two pieces 22 and 24 of titanium-6A1-4V alloy welded together along weld line 26. The plasma descaling process is particularly suited for preparing the faying surfaces of the pieces along the weld line 26. Generally we plasma descale the entire surface of the pieces in preparation of their electron beam welding.

The following example illustrates our preferred plasma descaling process.

EXAMPLE

Two samples of heat-treated titanium alloy were descaled, one in $SF_6$ and the other in $CF_4$ plasmas. Each sample measured 0.5×1.5×0.125 inches. Since the 6.3 liter volume plasma chamber used for descaling was only able to accept 5-inch wide wafers, each sample 10 (FIG. 1) was adhered to an upper surface of a five-inch silicon wafer 12 with photoresist material 14 to load the sample into the chamber. To provide a comparison between the descaled and original surfaces, one side of the upper surface 10*a* of each sample was covered with a strip of silicon 16 adhered to the face of the sample with photoresist 14 to provide a mask, while the other side 10*b* was exposed to the plasma The $CF_4$ descaling used a flow rate of 45 $cm^3$/min $CF_4$ through the chamber along with 2 $cm^3$/min oxygen. The plasma descaling continued for 6 hours, 30 minutes in thirteen, sequential, 30 minutes periods. We used six exposures (cycles) at 200 watts, six cycles at 300 watts, and thereafter a final cycle at 300 watts.

The $SF_6$ descaling used a flow rate of 45 standard $cm^3$/min $SF_6$ and 2 $cm^3$/min oxygen for a total of two hours. The descaling included a sequence of three 15-minute cycles at 350 watts, four 15-minute cycles at 400 watts, and a final 15-minute cycle at 400 watts. The increase in power increases the temperature of the part.

Each sample was descaled until its surface appeared visually clear and free of surface scale. Scale removal was confirmed by visual examination of cross sections of the specimens at 1,000 times magnification. No intergranular attack was visible. Intergranular attack is a problem because such attack can leave initiation sites (point sources) in the metal for cracking. Cracking is particularly a concern for titanium and its alloys which are highly crack sensitive. Cracks can lead to catastrophic failure. In the process for removal of surface oxides, therefore, it is particularly important to remove all the oxides without causing significant intergranular attack, because either the oxides or the intergranular attack can lead to catastrophe. The plasma descaling process of the present invention removes the surface oxides selectively and, with appropriate control of the reaction temperature, is self-limiting to avoid the problems associated with intergranular attack.

While we have described preferred embodiments, those skilled in the art will readily recognize alternatives, variations, and modifications which might be made without departing from the inventive concept. Therefore, interpret the claims liberally with the support of the full range of equivalents known to those of ordinary skill based upon this description. The examples illustrate the invention and are not intended to limit it Accordingly, define the invention with the claims and limit the claims only as necessary in view of the pertinent prior art.

We claim:

1. A process for removing surface oxides from metal, comprising the steps of:

(a) heating the metal having surface oxides in the form of scale, alpha case, or both in a vacuum chamber at a pressure of about 0.13–0.40 Pascal; and (b) contacting the heated metal with a flowing plasma adapted to descale the surface oxide without causing intergranular attack for a sufficient time to remove the surface oxides.

2. The process of claim 1 wherein the plasma descaling occurs in a series of cycles of increasing power.

3. The process of claim 2 wherein the plasma contains fluoride ions.

4. The process of claim 3 wherein the plasma is generated from a source gas containing $SF_6$, $CF_4$, $NF_3$, or mixtures thereof.

5. The process of claim 4 wherein the metal includes titanium.

6. The process of claim 5 wherein the surface oxides include both scale and alpha case.

7. The process of claim 5 wherein the metal is heated to a temperature in the range from about 220–520° C., the descaled metal has a surface finish of about $R_a$ 30–60, and the descaled metal is free from risk of hydrogen embrittlement because the metal is not exposed to hydrogen during descaling.

8. The process of claim 1 wherein the flowing plasma includes oxygen.

9. The process of claim 1 wherein the plasma descaling occurs in a series of cycles of increasing part temperature.

10. The process of claim 1 wherein the metal is heated to a temperature in the range from about 220–520° C.

11. A process for removing surface oxides, including both scale and alpha case, a part made from titanium or titanium alloys, comprising the steps of:

(a) heating the part that includes surface oxides in the form of scale, alpha case, or both in a vacuum chamber at a pressure no greater than about 0.40 Pascal;

(b) contacting the heated part with a flowing plasma adapted to descale the surface oxide, the plasma containing oxygen and fluoride ions; and (c) maintaining contact of the heated part with the plasma for a time sufficient to remove the surface oxides without causing intergranular attack and to provide a surface finish of about $R_a$ 30–60 without the risk of hydrogen embrittlement.

12. A process for making welded titanium structure comprising the steps of:

(a) plasma descaling titanium alloy parts in a flowing fluoride ion plasma at a temperature in the range from about 220–520° C. to produce part surfaces free of surface oxides, free of the risk of hydrogen embrittlement, free of intergranular attack, and having a surface finish of about $R_a$ 30–60; and (b) welding the descaled parts along a weld line.

* * * * *